United States Patent [19]

Uchida et al.

[11] Patent Number: 4,920,819

[45] Date of Patent: May 1, 1990

[54] JUNCTION UNIT USED IN DUAL STATION SYSTEM

[75] Inventors: Tatsumi Uchida; Yoshikazu Hoshina, both of Yokohama; Seiichi Nishimura, Hamamatsu, all of Japan

[73] Assignees: NHK Morse Co., Ltd., Yokohama; Sanshin Industries Co., Ltd., Shizuoka, both of Japan

[21] Appl. No.: 313,792

[22] Filed: Feb. 21, 1989

[30] Foreign Application Priority Data

Mar. 4, 1988 [JP] Japan ..... 63-51208
Apr. 14, 1988 [JP] Japan ..... 63-92042

[51] Int. Cl.[5] ..... G05G 11/00
[52] U.S. Cl. ..... 74/480 B; 74/483 R
[58] Field of Search ..... 74/480 B, 483 R, 480 R, 74/479; 192/0.098; 440/84

[56] References Cited

U.S. PATENT DOCUMENTS 3,651,709 3/1972 Booty et al. ..... 74/483 R
3,842,689 10/1974 Bagge ..... 74/483 R X
4,020,713 5/1977 Cantley et al. ..... 74/480 B X

FOREIGN PATENT DOCUMENTS 61-29068 8/1986 Japan .
2109887 6/1983 United Kingdom ..... 74/483 R

*Primary Examiner*—Laurie K. Cranmer
*Attorney, Agent, or Firm*—Frishauf, Holtz, Goodman & Woodward

[57] ABSTRACT

A body has a guide members extending along the axis of the body. A pair of racks held by the body are movable along the guide members. The first rack is connected to a first remote control unit through a first cable. The second rack is connected to a second remote control unit through a second cable. When one of the first and second racks is moved from a reference position, the lock members locks the movement of the other rack. An intermediate gear is arranged between the first and second racks. An interlocking member is connected to the intermediate gear. When one rack is moved, the intermediate gear is moved in the same direction as the moved rack. The movement of the intermediate gear is transmitted to equipment to be controlled through the interlocking member.

2 Claims, 16 Drawing Sheets

JUNCTION UNIT USED IN DUAL STATION SYSTEM

BACKGROUND OF THE INVENTION

1. Field of the Invention

The present invention relates to a junction unit used in a dual station system having two remote control units.

2. Description of the Related Art

In order to operate equipment to be controlled, a remote control system using a push-pull cable is used. For example, when an engine is remote-controlled from a position on a bridge or in a cabin in a small ship, or when a hydraulic apparatus or the like is remote-controlled from a driver's seat or outside the vehicle in a construction vehicle, a dual station system is used so that the equipment to be controlled can be controlled from both the two remote locations.

A conventional dual station system wherein operation levers of two remote control units are connected in series with each other through a cable is known. In the conventional system, when one operation lever is operated, the operation lever of the other control unit is simultaneously moved through the cable. This reason, a large operating force is required, and a service life of the cable is short.

In order to eliminate the above drawbacks, a switching apparatus disclosed in Japanese Utility Model Publication No. 61-29068 (issued by the Japan Patent Office) is proposed. The switching apparatus of this related art is arranged between two remote control units and one equipment to be controlled. A plurality of systems of cables for coupling the switching apparatus and the control units are connected to a latch member having a special shape and arranged in the switching apparatus. The latch member is switched by a manual operation member. When the position of the latch member is selected by the operation member, the equipment can be controlled using the cable of the selected one of the two control units.

However, in the related art described above, the operation member must be switched every time the operation system is switched, resulting in a cumbersome operation. In addition, since this switching apparatus requires the operation member and various members connected to the operation member, its structure is complicated and requires a large number of parts.

SUMMARY OF THE INVENTION

It is therefore an object of the present invention to provide a junction unit which does not require an operation member for switching operation systems in a dual station system comprising two remote control units. It is another object of the present invention to provide a junction unit which can automatically lock the other control unit when an engine is controlled by one control unit, in a dual station system for controlling an engine of a ship or the like.

According to the junction unit of the present invention, when one of two control units is operated by one operator, the other control unit is automatically locked. For this reason, another operator can be prevented from erroneously operating equipment to be controlled using the other control unit. The equipment to be controlled can be operated using one of the two control units, which is operated first, and the other control unit is automatically locked. Thus, no switching operation member is required.

The junction unit according to the present invention comprises:

a body having one axis;

guide means arranged on the body and extending parallel to the axis;

first and second movable racks arranged to be movable from reference positions in the axial direction of the body along the guide means, the racks having opposing gears, and being arranged parallel to each other;

an intermediate gear located between the two racks to mesh with the gears of the racks to be movable in the axial direction of the body;

a first control cable connected to the first movable rack and the first remote control unit;

a second control cable connected to the second movable rack and the second remote control unit;

an interlocking member for, when the intermediate gear is moved in the axial direction of the body, transmitting the movement to the equipment to be controlled; and lock means for, when one of the first and second racks is moved in the axial direction of the body, locking movement of the other rack.

DETAILED DESCRIPTION OF THE PREFERRED EMBODIMENTS

Figure 1:
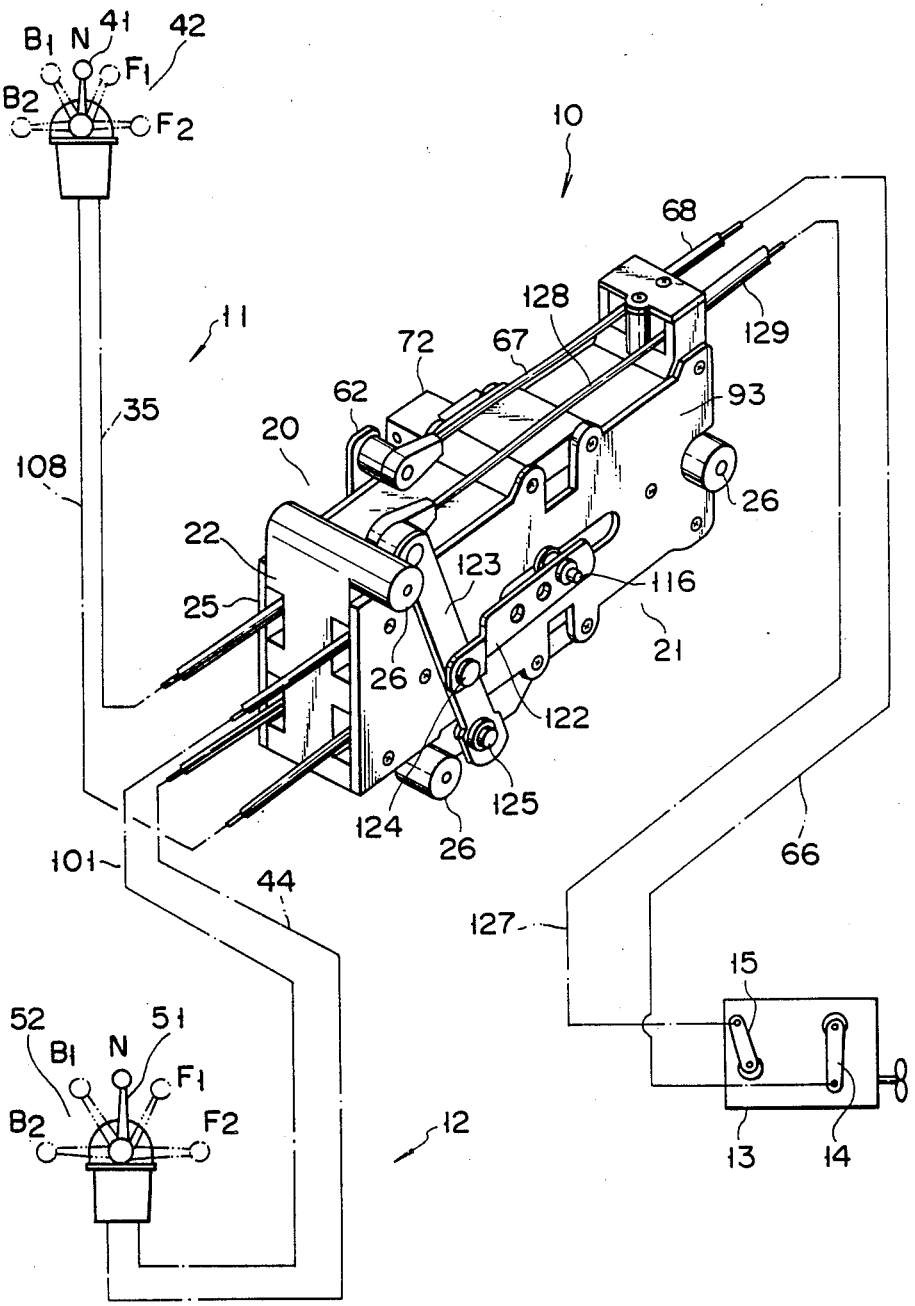
FIG. 1 is a perspective view of a junction unit for controlling an engine according to a first embodiment of the present invention.

A dual station engine control system 10 for a small ship shown in FIG. 1 comprises a first operation system 11 and a second operation system 12. A gear shifter 14 and a throttle lever 15 of an engine 13 can be controlled using either one of the two operation systems 11 and 12. The shifter 14 is operated through a shift junction unit 20. The throttle lever 15 is operated through a throttle junction unit 21. The junction units 20 and 21 are assembled in one body 22, and the body 22 is housed in a watertight casing (not shown) as needed. In FIGS. 4 to 12, the two junction units 20 and 21 are illustrated in a separated state for the purpose of easy understanding of their structures and operations.

Figure 4:
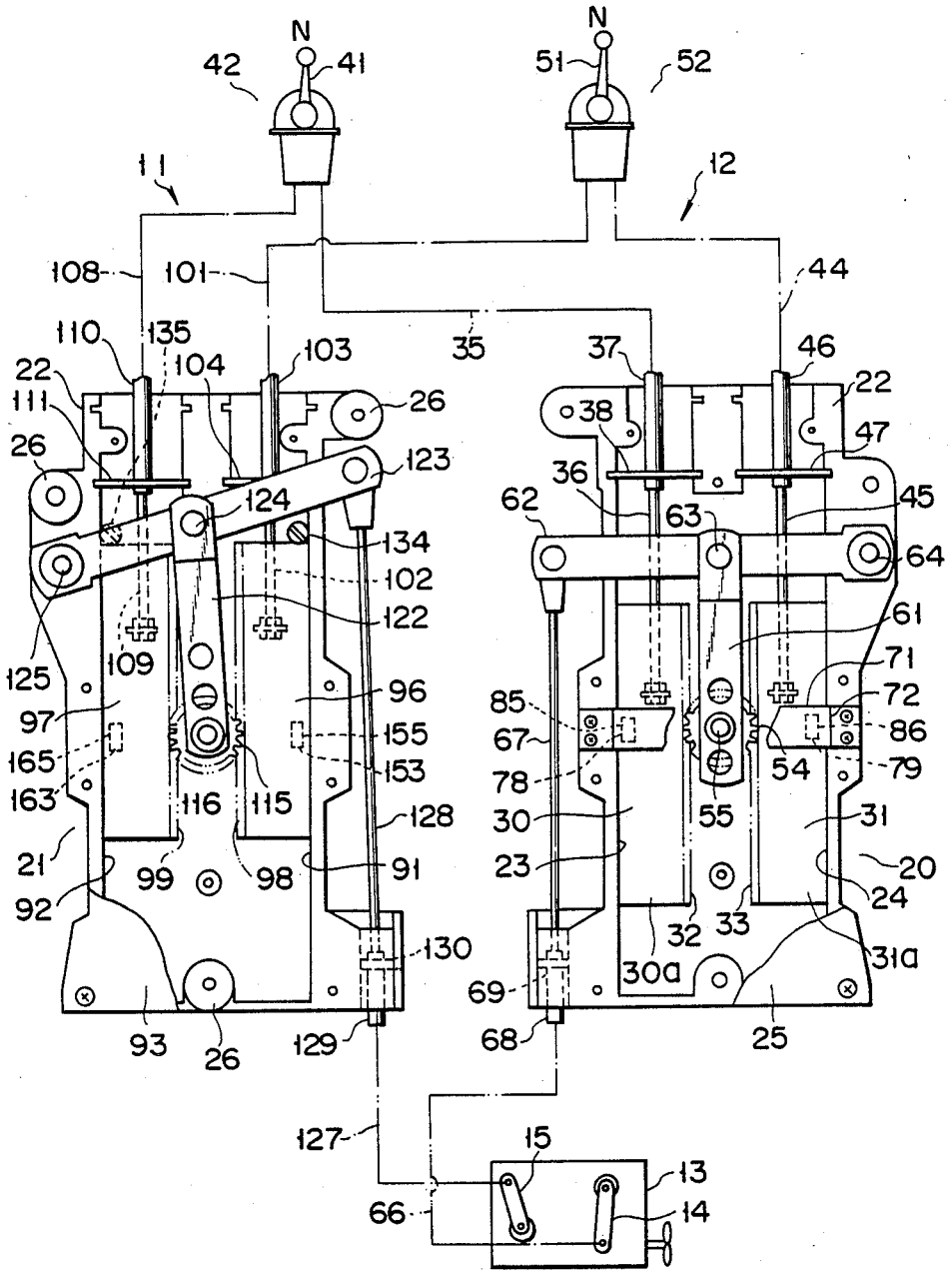
FIGS. 4 to 12 are plan views showing different operating states of the junction unit shown in FIG. 1.

As shown in the right half of FIG. 4, the body 22 of the shift function unit 20 comprises a pair of guide walls 23 and 24 extending along the axis of the body 22. The guide walls 23 and 24 are covered with a cover plate 25 (partially illustrated in FIG. 4). A mounting base 26 formed on the body 22 is fixed to a base mounted on a ship body (not shown).

First and second movable racks 30 and 31 are arranged between the guide walls 23 and 24. Gears 32 and 33 of the racks 30 and 31 oppose each other. The racks 30 and 31 extend parallel to each other, and are movable in the axial direction of the body 22 along the guide walls 23 and 24. A core rod 36 of a first push-pull cable (or remote control cable) 35 is connected to the first rack 30. One end of an outer tube 37 of the remote control cable 35 is fixed to the body 22 through a fixing member 38. The other end of the cable 35 is connected to a shift control member of a first remote control unit 42 with an operation lever 41.

The first control unit 42 is arranged near a main operation seat of the ship. The control unit 42 is the same as a known single-lever type control unit. When the lever 41 is shifted from a neutral position N to a forward position $F_1$ (FIG. 5), the core 36 of the first cable 35 is moved in a push direction. When the lever 41 is pivoted from the position $F_1$ toward a position $F_2$ (FIG. 6), a core 109 of a fourth cable 108 (to be described later) is moved in the push direction. When the lever 41 is shifted to a backward position $B_1$ (FIG. 7), the core 36 of the first cable 35 is moved in a pull direction. When the lever 41 is pivoted from the position $B_1$ toward a position $B_2$ (FIG. 8), the core 109 of the cable 108 is moved in the push direction.

The control unit 42 has an operation member (not shown) for an idling operation. When this operation member is operated and the lever 41 is shifted toward the position $F_1$ (FIG. 11), the core 109 of the cable 108 is moved in the push direction.

A core rod 45 of a second push-pull cable (or control cable) 44 is connected to the second rack 31. One end of an outer tube 46 of the control cable 44 is fixed to the body 22 through a fixing member 47. The other end of the cable 44 is connected to a shift control member of a second remote control unit 52 with an operation lever 51.

The second control unit 52 is arranged at a position other than the main operation seat. When the lever 51 of the control unit 52 is shifted to a forward position $F_1$ (FIG. 9), the core 45 of the second cable 44 is moved in the push direction. When the lever 51 is further pivoted from the position $F_1$ toward a position $F_2$, a core 102 of a third cable 101 is moved in the push direction. When the lever 51 is shifted to a backward position $B_1$ (FIG. 10), the core 45 of the second cable 44 is moved in the pull direction. When the lever 51 is further pivoted from the position $B_1$ toward a position $B_2$, the core 102 of the cable 101 is moved in the push direction.

This control unit 52 also comprises an operation member (not shown) for an idling operation. When this operation member is operated and the lever 51 is shifted in the $F_1$ direction (FIG. 12), the core 102 of the cable 101 is moved in the push direction.

The gears 32 and 33 of the racks 30 and 31 are meshed with a first intermediate gear 54. The gear 54 is movable in the longitudinal direction of the racks 30 and 31, i.e., in the axial direction of the body 22.

One end of a link 61 is pivotally supported on a shaft 55 of the gear 54. The other end of the link 61 is coupled to a link 62 through a shaft 63. One end of the link 62 is pivotally supported on the body 22 through a shaft 64. The link 62 is pivotal about the shaft 64. The other end of the link 62 is coupled to a core rod 67 of a shift control push-pull cable 66. One end of an outer tube 68 of the shift cable 66 is fixed to the body 22 through a fixing member 69. The other end of the cable 66 is connected to the shifter 14 of the engine 13.

Figure 2:
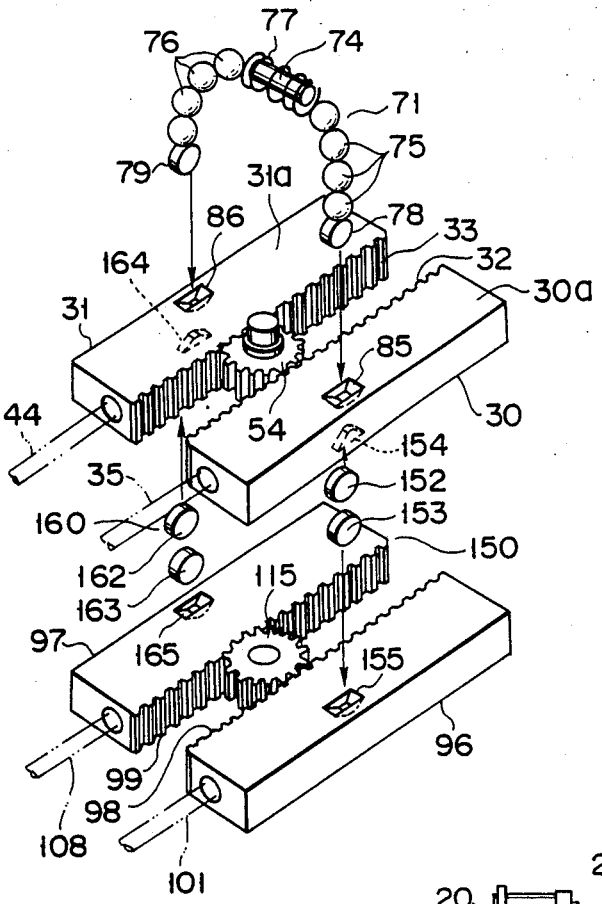
FIG. 2 is an exploded perspective view showing lock means shown in FIG. 1.
Figure 3:
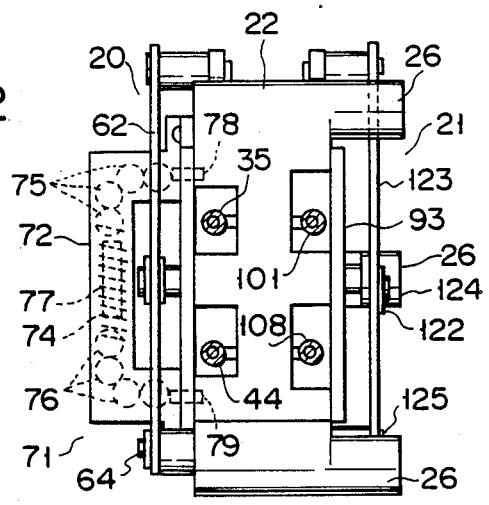
FIG. 3 is a front view of the junction unit shown in FIG. 1.
Figure 13:
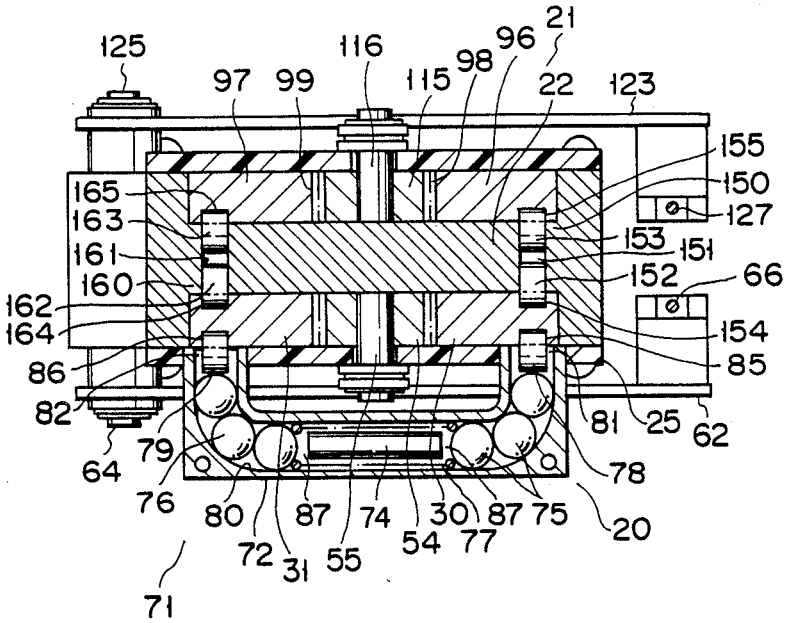
FIGS. 13 to 17 are sectional views showing different operating states of the junction unit shown in FIG. 1.

The body 22 has a first lock means 71. As shown in FIG. 2 or 3, a rod 74, balls 75 and 76, a compression coil spring 77, and lock members 78 and 79 are arranged inside a housing 72 of the lock means 71. The spring 77 biases the balls 75 and 76 in a direction separating from the end face of the rod 74. As shown in FIG. 13, the members 74 to 79 are housed in a guide hole 80 formed inside the housing 72 and having a U-shaped axis. The members 74 to 79 are movable in the axial direction of the hole 80. Two end openings 81 and 82 of the U-shaped guide hole 80 face the racks 30 and 31, respectively. The lock members 78 and 79 are rotatably housed in the openings 81 and 82. The lock members 78 and 79 may have a spherical shape.

V-shaped recesses 85 and 86 are formed in surfaces 30*a* and 3l*a* of the racks 30 and 31, respectively. The recesses 85 and 86 oppose the openings 81 and 82 of the guide hole 80 when the racks 30 and 31 are located at neutral positions of their movement strokes. Therefore, when the racks 30 and 31 are located at the neutral positions, the lock members 78 and 79 are fitted in the recesses 85 and 86 by the biasing force of the spring 77. A clearance 87 (FIG. 13) between the end faces of the rod 74 and the balls 75 and 76 allows one of the lock members 78 and 79 to run onto the surface 30*a* or 3l*a* of the rack 30 or 31.

The throttle junction unit 21 will be described below. As shown in the left half of FIG. 4, the body 22 has a pair of guide walls 91 and 92. The guide walls 91 and 92 are parallel to the above-mentioned guide walls 23 and 24. The guide walls 91 and 92 are covered with a cover plate 93.

Third and fourth movable racks 96 and 97 are arranged between the guide walls 91 and 92. The third rack 96 is arranged behind the first rack 30. The fourth rack 97 is arranged behind the second rack 31. Gears 98 and 99 of the racks 96 and 97 oppose each other. The racks 96 and 97 are movable in the axial direction of the body 22 along the guide walls 91 and 92. The third rack 96 is connected to the core rod 102 of the third push-pull cable (or control cable) 101. One end of an outer tube 103 of the control cable 101 is fixed to the body 22 through a fixing member 104. The other end of the cable 101 is connected to a throttle control member of the second control unit 52.

The fourth rack 97 is connected to the core rod 109 of the fourth push-pull cable (or control cable) 108. One end of an outer tube 110 of the control cable 108 is fixed to the body 22 through a fixing member 111. The other end of the cable 108 is connected to a throttle control member of the first remote control unit 42.

The gears 98 and 99 of the racks 96 and 97 are meshed with a second intermediate gear 115. The gear 115 is movable in the longitudinal direction of the racks 96 and 97.

One end of a link 122 is pivotally supported on a shaft 116 of the gear 115. The other end of the link 122 is coupled to a link 123 through a shaft 124. One end of the link 123 is pivotally supported on the body 22 through a shaft 125. The link 123 is pivotal about the shaft 125. The other end of the link 123 is coupled to a core rod 128 of a throttle control push-pull cable 127. One end of an outer tube 129 of the throttle cable 127 is fixed to the body 22 through a fixing member 130. The other end of the cable 127 is connected to the throttle level 15 of the engine 13. Stoppers 134 and 135 used for preventing return of the racks 96 and 97 are arranged at positions to oppose one end faces of the racks 96 and 97 in the longitudinal direction.

As shown in FIG. 2, a second lock means 150 is arranged between the first and third racks 30 and 96. A third lock means 160 is arranged between the second and fourth racks 31 and 97. As shown in FIG. 13, the second lock means 150 comprises a hole 151 extending through the body 22 in the direction of thickness, lock members 152 and 153 rotatably housed in the hole 151, and V-shaped recesses 154 and 155 formed in the racks 30 and 96. The recesses 154 and 155 are arranged at corresponding positions. When the hole 151 opposes the recesses 154 and 155, the lock members 152 and 153 are fitted in the recesses 154 and 155. The number of the lock members 152 and 153 can be one or three or more.

The third lock means 160 comprises a hole 161 extending through the body 22 in the direction of thickness, lock members 162 and 163 rotatably housed in the hole 161, and V-shaped recesses 164 and 165 formed in the racks 31 and 97. The recesses 164, 165 are formed at corresponding positions. The number of the lock members 162 and 163 can be one or three or more. The lock members 152, 153, 162, and 163 may comprise balls.

Interlocking members other than the links 61, 62, 122, and 123 may be attached to the intermediate gears 54 and 115.

The operation of the engine control system 10 comprising the junction units 20 and 21 will now be described.

As shown in FIG. 4, when the levers 41 and 51 of the control units 42 and 52 are respectively located at their neutral positions, the shifter 14 of the engine 13 is in a neutral state, and the throttle lever 15 is in an idling state.

Figure 5:
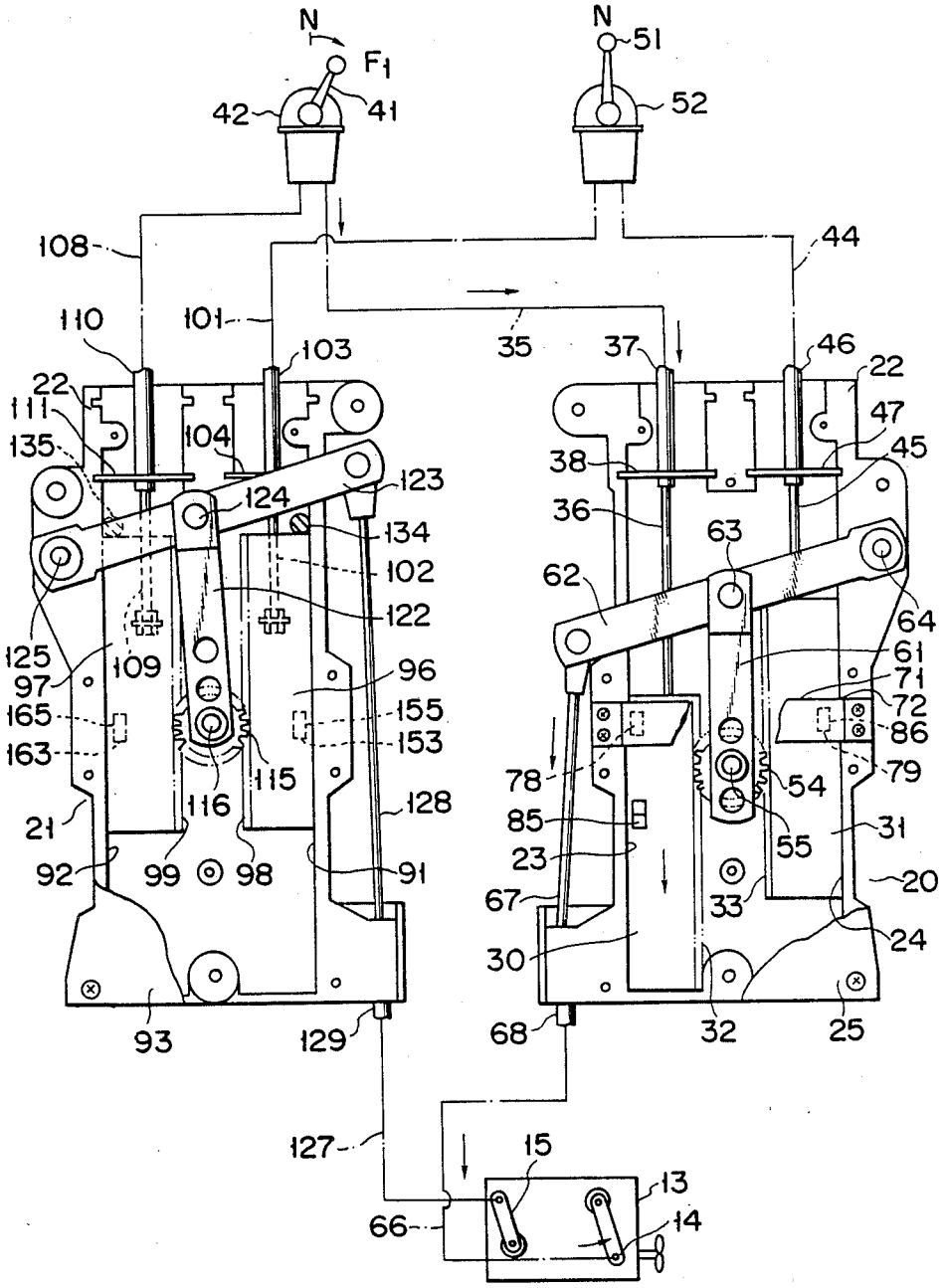
Figure 14:
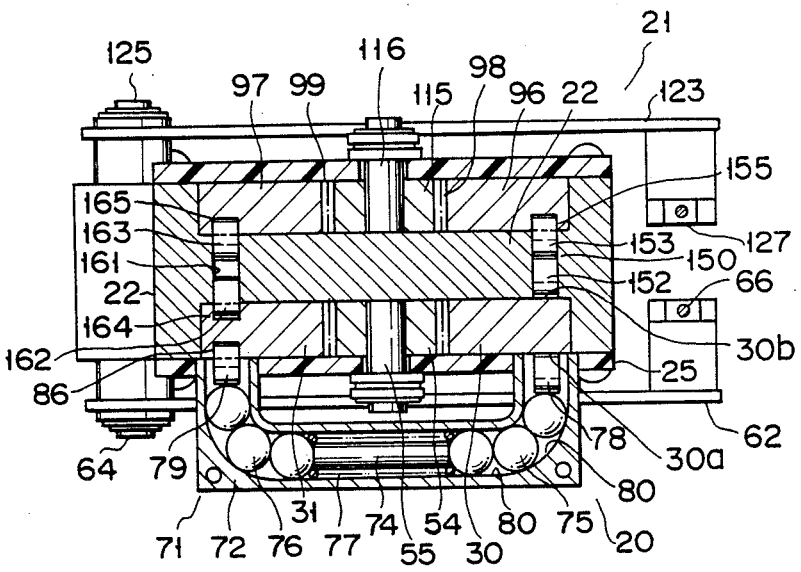

As shown in FIG. 5, when the lever 41 of the first control unit 42 is shifted to the position $F_1$, the core 36 of the cable 35 is moved in the push direction, and one rack 30 is moved in a direction indicated by an arrow in FIG. 5. When the rack 30 is moved in this direction, the lock member 78 in the first lock means 71 runs onto the surface 30*a* of the rack 30, as shown in FIG. 14. As a result, the rod 74 is pushed by the balls 75. For this reason, the other lock member 79 is kept fitted in the recess 86. Therefore, the second rack 31 is locked. In the second lock means 150, the lock member 152 runs onto a surface 30*b* of the first rack 30, and the other lock member 153 is pushed toward the recess 155. As a result, the third rack 96 is locked. Therefore, the rack 96 can no longer be moved using the second control unit 52. For this reason, when the shifter 14 is shifted to the forward position by the first control unit 42, the second control unit 52 can be prevented from being erroneously set in the idling operation mode.

When the first rack 30 is moved in the direction of arrow in FIG. 5, the intermediate gear 54 meshing with the rack 30 is moved in the same direction as the rack 30. When the gear 54 is moved, the core 67 of the cable 66 is pushed through the links 61 and 62, and the shifter 14 is shifted to the forward position. When the lever 41 is returned to the N (neutral) position, since the core 36 is pulled, the rack 30 is returned to the original neutral position, and the lock member 78 is fitted again in the recess 85.

Figure 6:
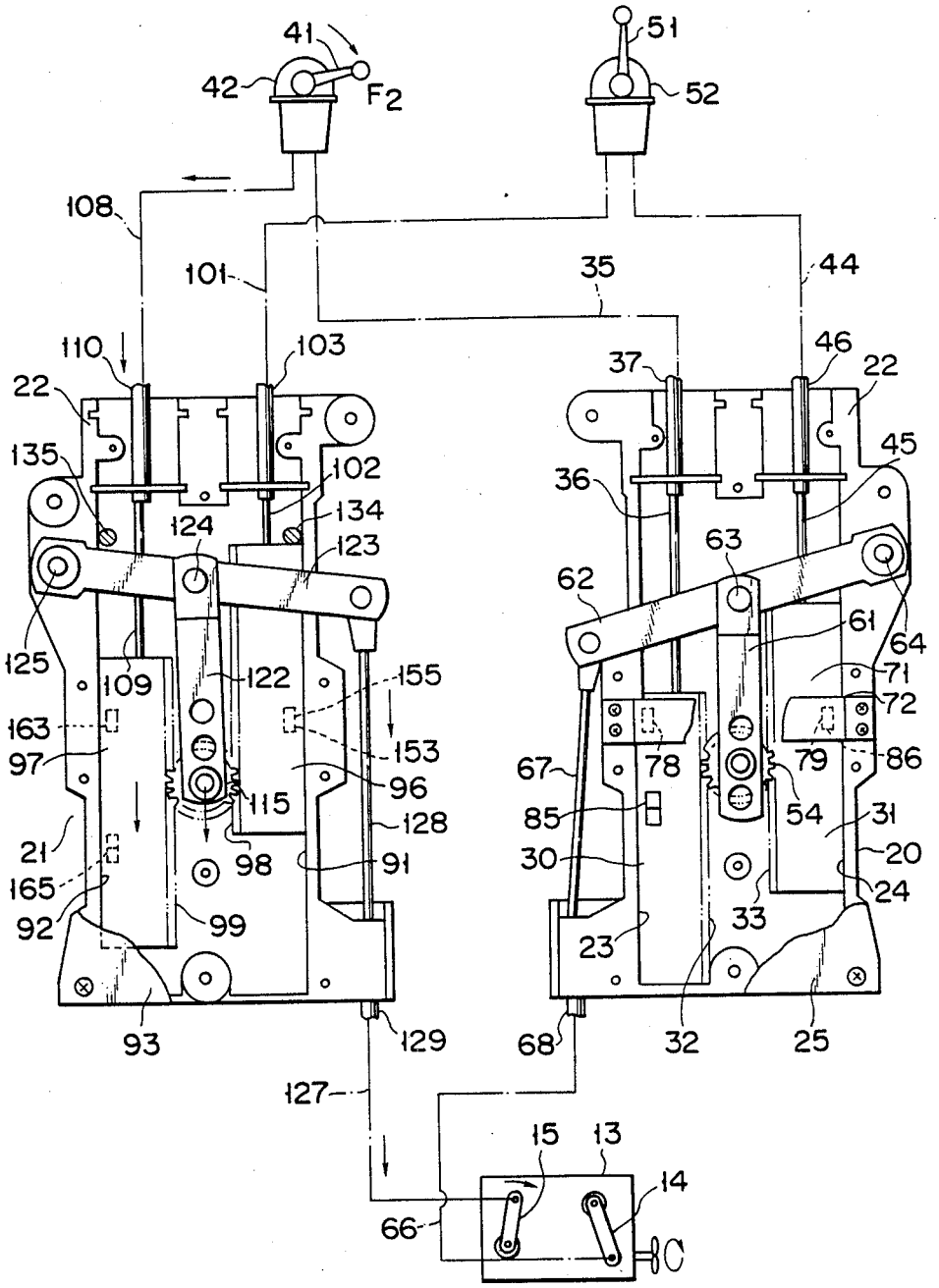
Figure 15:
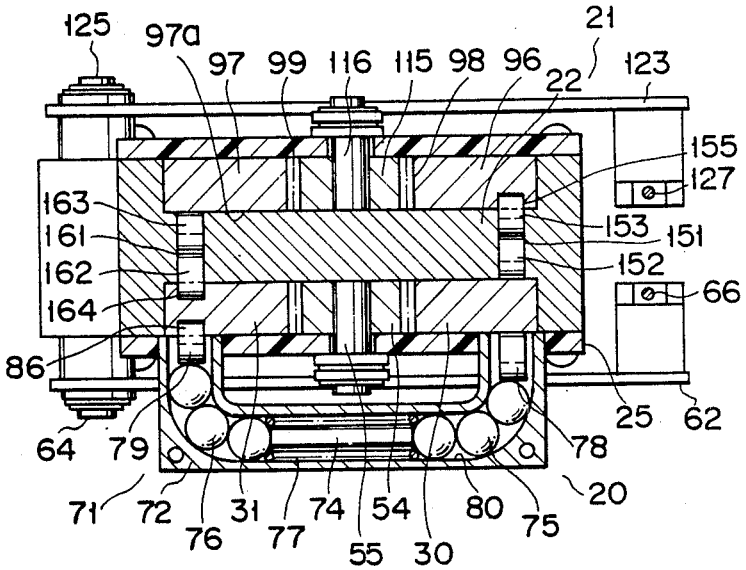

When the lever 41 is pivoted in the $F_2$ direction, as shown in FIG. 6, the core 109 of the cable 108 and the fourth rack 97 are moved in the direction of arrow in FIG. 6. When the intermediate gear 115 is moved in the same direction as the rack 97 while being rotated, a counter force acts on the third rack 96. However, since the stopper 134 abuts against one end face of the rack 96, the rack 96 is held at the initial position. When the lock member 163 runs onto a surface 97*a* of the rack 97, as shown in FIG. 15, the lock member 162 is pushed toward the recess 164, and hence, the rack 31 is locked. Therefore, in this case, the rack 31 can no longer be moved by the second control unit 52.

When the intermediate gear 115 is moved in a direction of arrow in FIG. 6, the core 128 of the cable 127 is pushed through the links 122 and 123. As a result, the throttle lever 15 can be moved.

Figure 7:
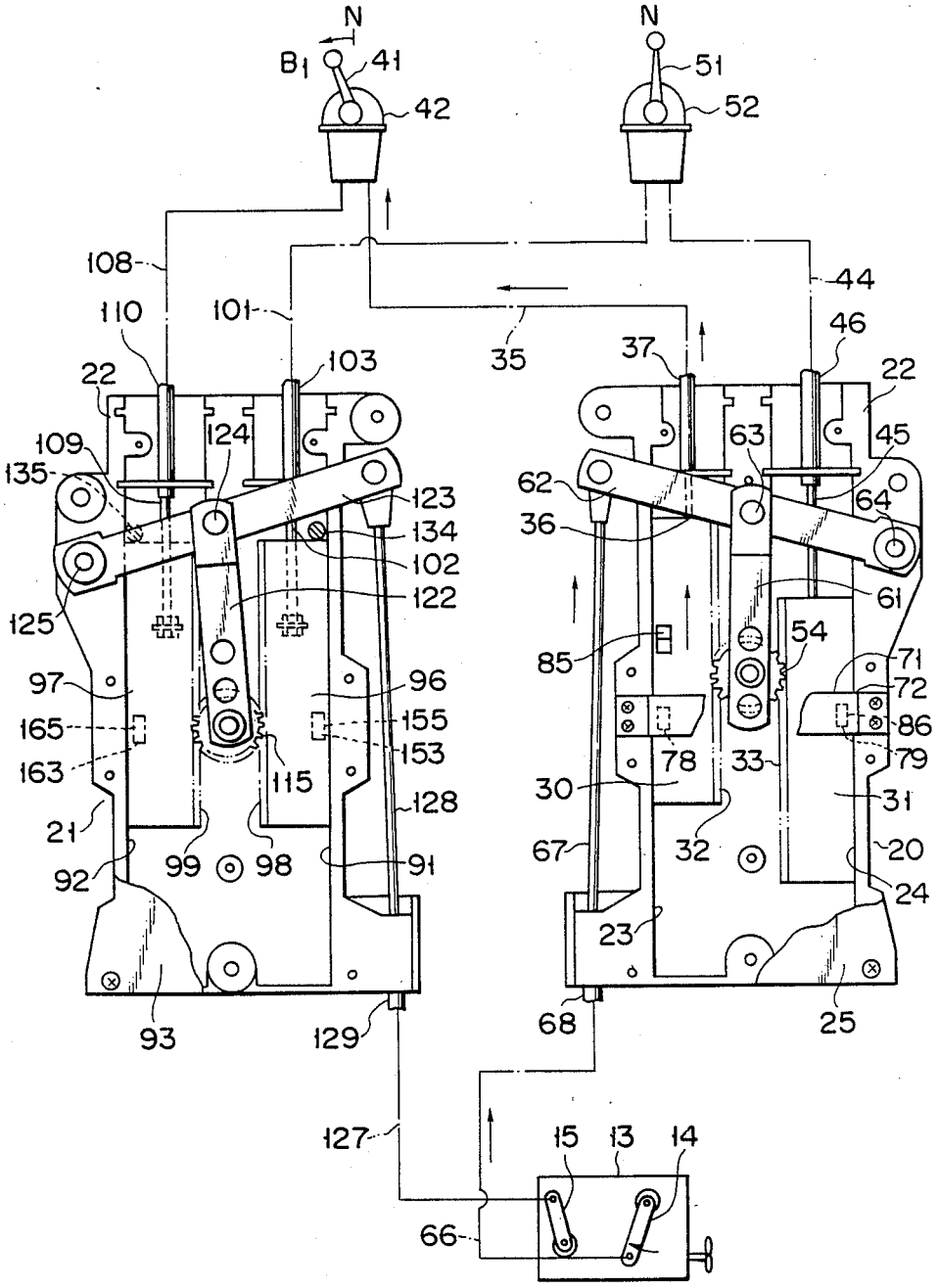

When the lever 41 of the first control unit 42 is shifted to the $B_1$ position, as shown in FIG. 7, the core 36 of the cable 35 is pulled. As a result, the first rack 30 is moved in a direction of arrow in FIG. 7. In this case, as shown in FIG. 14, since one lock member 78 runs onto the surface 30*a* of the rack 30, the second rack 31 is locked by the other lock member 79. At the same time, the lock member 152 runs onto the surface 30*b* of the rack 30, so that the lock member 153 is pushed toward the recess 155. As a result, the third rack 96 is locked. When the rack 30 is moved in the direction of arrow in FIG. 7, the gear 54 is moved in the same direction as the rack 30. Therefore, the core 67 of the cable 66 is moved in the pull direction through the links 61 and 62. Therefore, the shifter 14 is shifted to the backward position.

Figure 8:
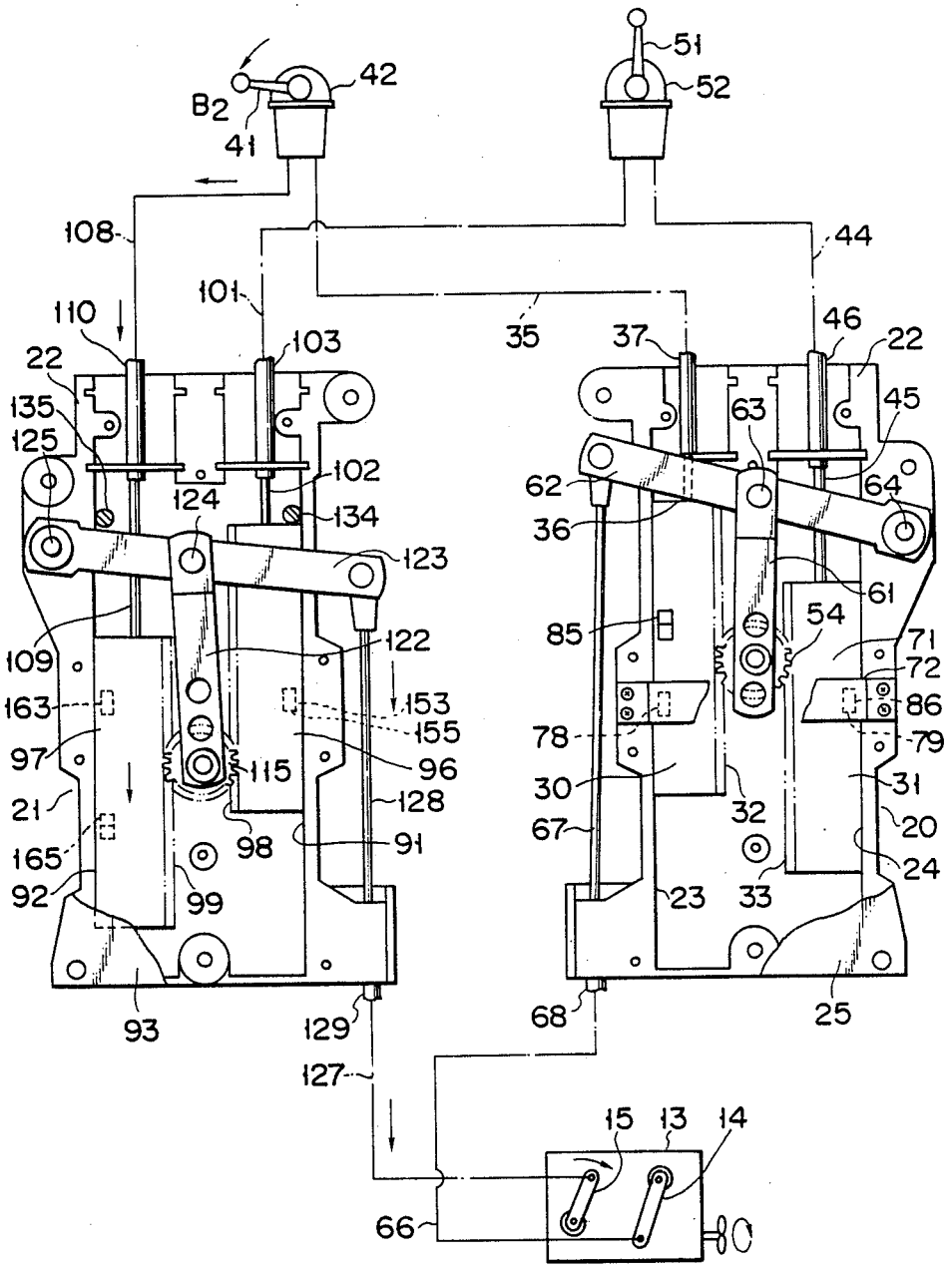

When the lever 41 is pivoted toward the $B_2$ position, as shown in FIG. 8, the core 109 of the cable 108 and the fourth rack 97 are moved in a direction of arrow in FIG. 8, and at the same time, the gear 115 is moved in the same direction as the rack 97. For this reason, the core 128 of the cable 127 is moved in the push direction through the links 122 and 123, and the throttle lever 15 is moved.

The above-mentioned operation is performed by the first control unit 42. The same operation as the above can be performed using the second control unit 52.

Figure 9:
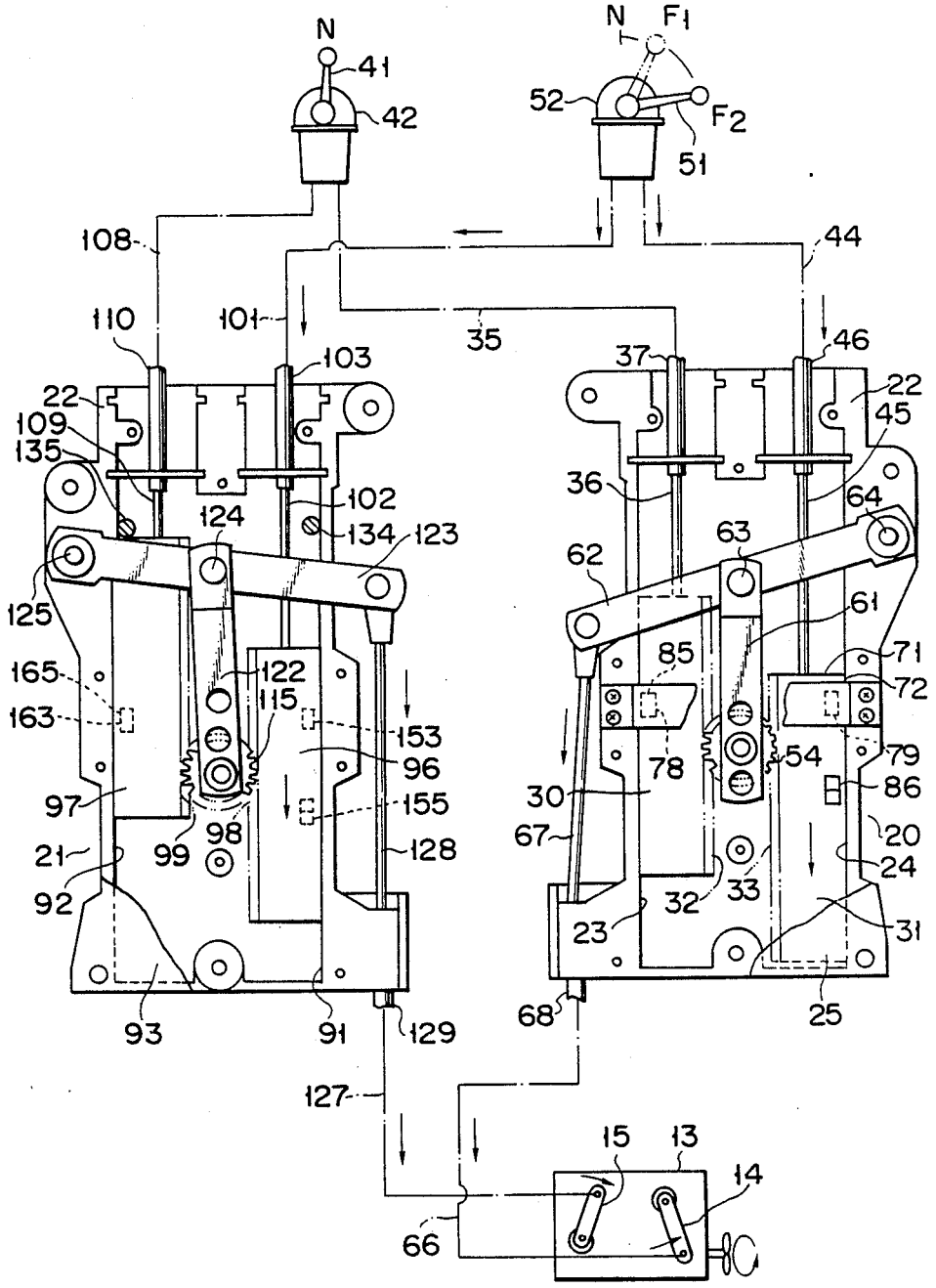

When the lever 51 of the second control unit 52 is pivoted toward the position $F_2$ through the forward position $F_1$, as shown in FIG. 9, the racks 31 and 96 are moved in a direction indicated by arrow in FIG. 9. As a result, the shifter 14 and the throttle lever 15 can be moved.

Figure 10:
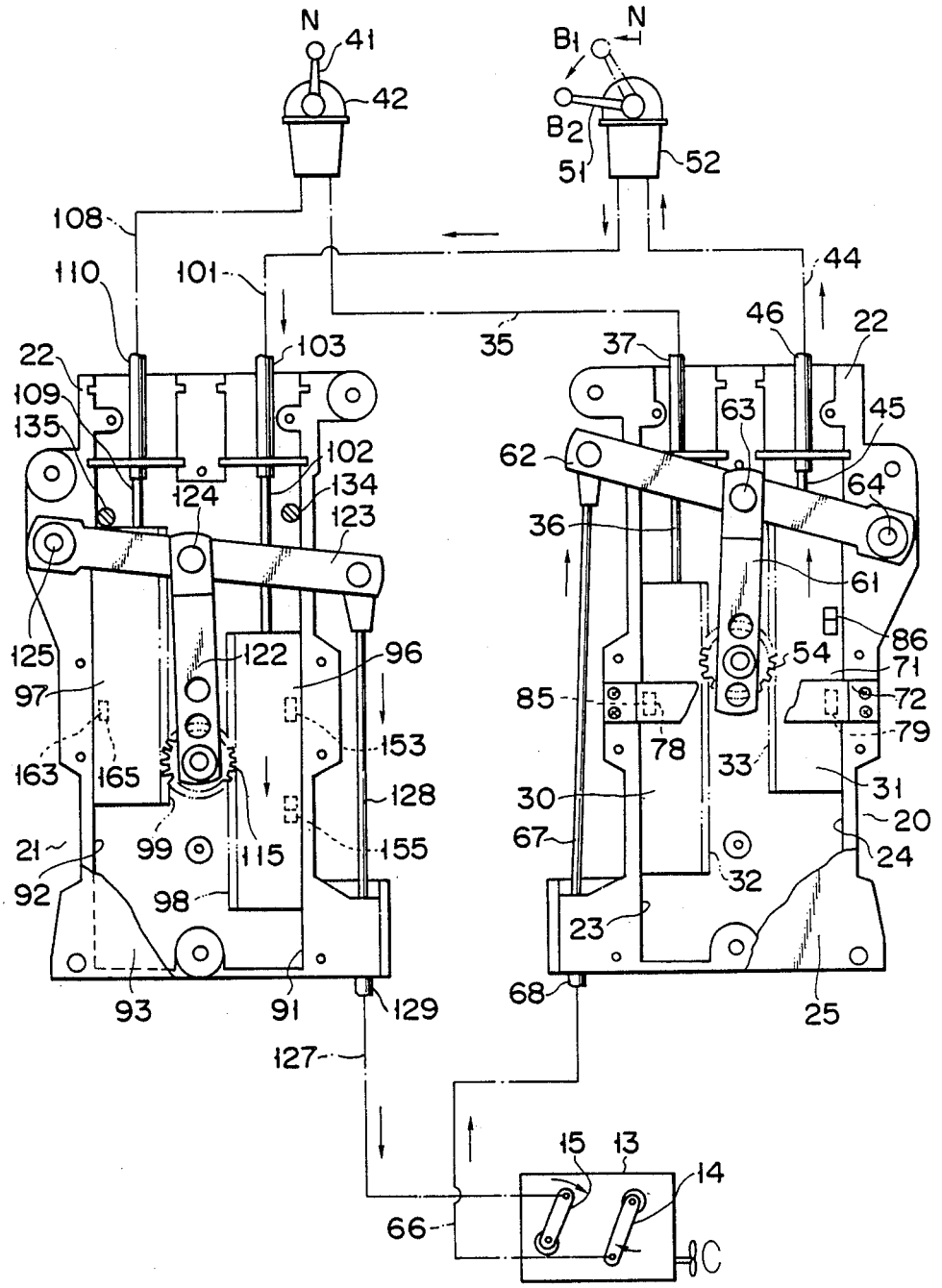

When the lever 51 is pivoted to the position $B_2$ via the backward position $B_1$, as shown in FIG. 10, the racks 31 and 96 are moved in a direction of arrow in FIG. 10, so that the shifter 14 and the throttle lever 15 are controlled.

Figure 11:
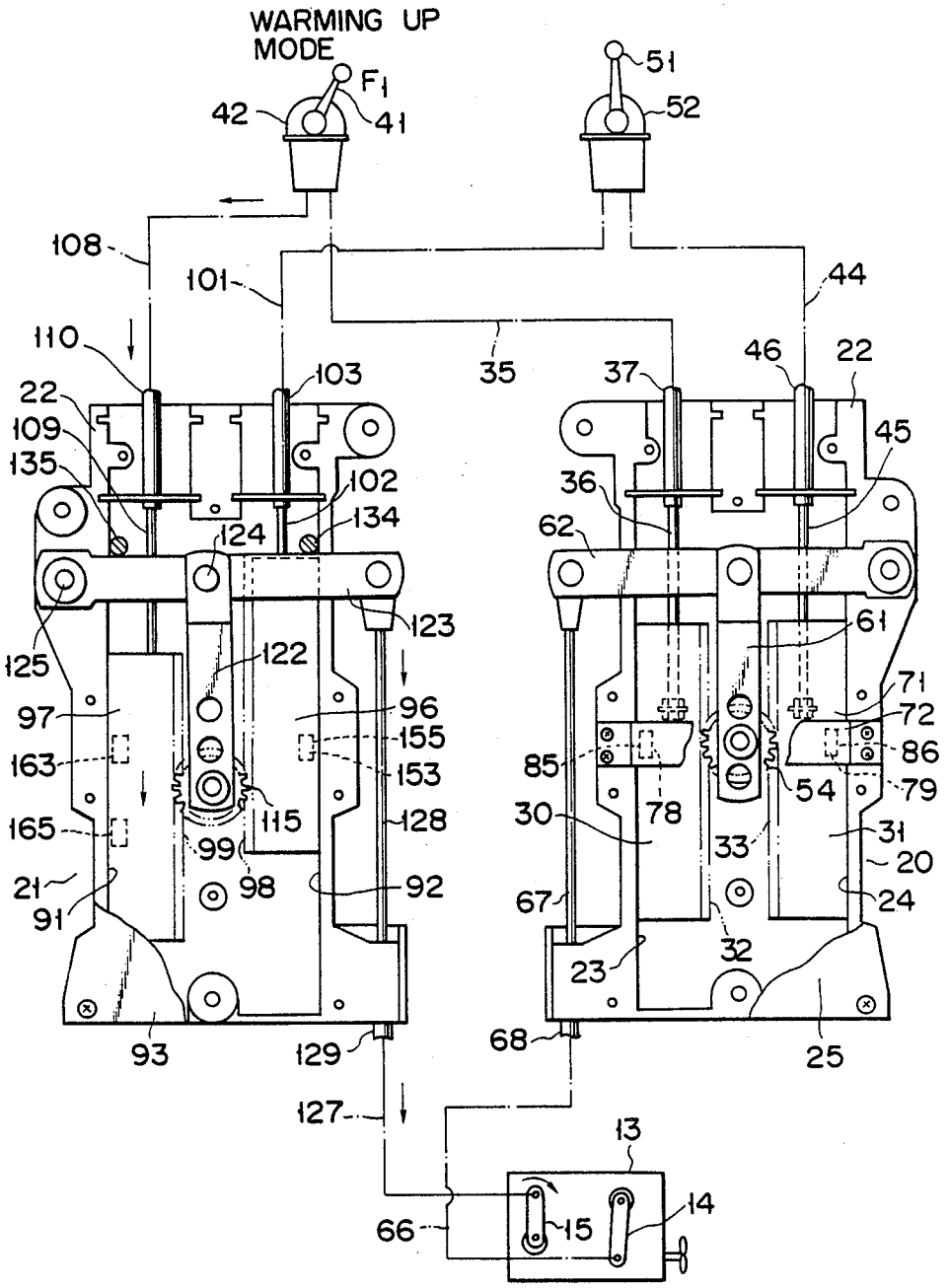
Figure 16:
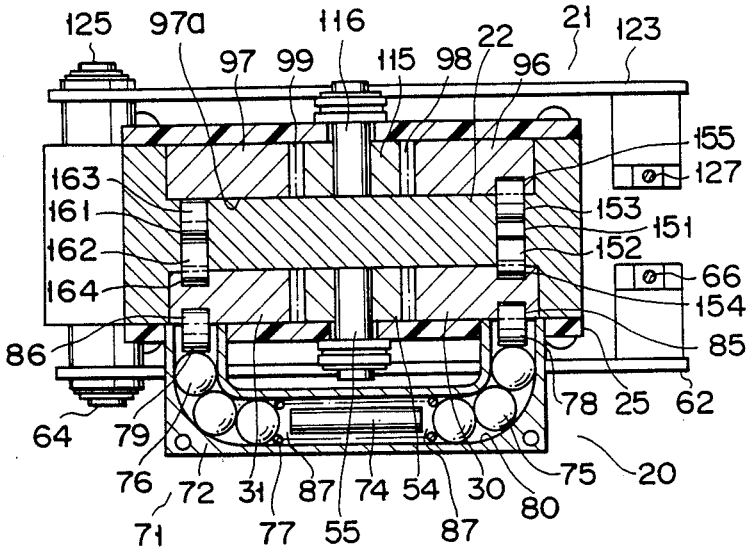

When the first control unit 42 is in the idling mode, as shown in FIG. 11, since the fourth rack 97 is moved by the cable 108, the throttle cable 127 is driven through the gear 115 and the links 122 and 123. In this case, as shown in FIG. 16, since the lock member 163 runs onto the surface 97*a* of the rack 97, the second rack 31 is locked by the lock member 162. For this reason, when the idling operation is performed using the first control unit 42, the lever 51 of the second control unit 52 can be prevented from being erroneously shifted to the forward or backward position.

Figure 12:
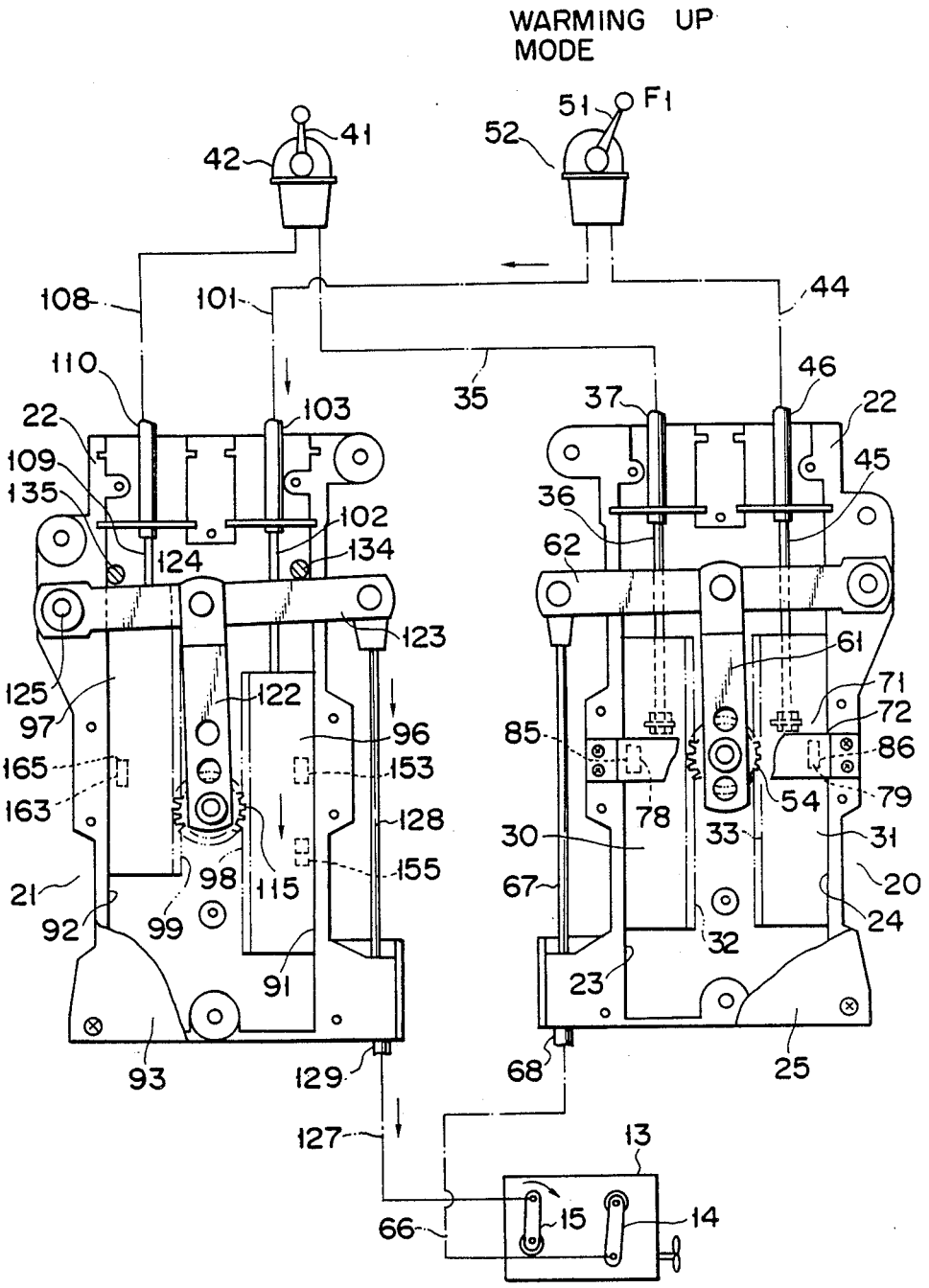
Figure 17:
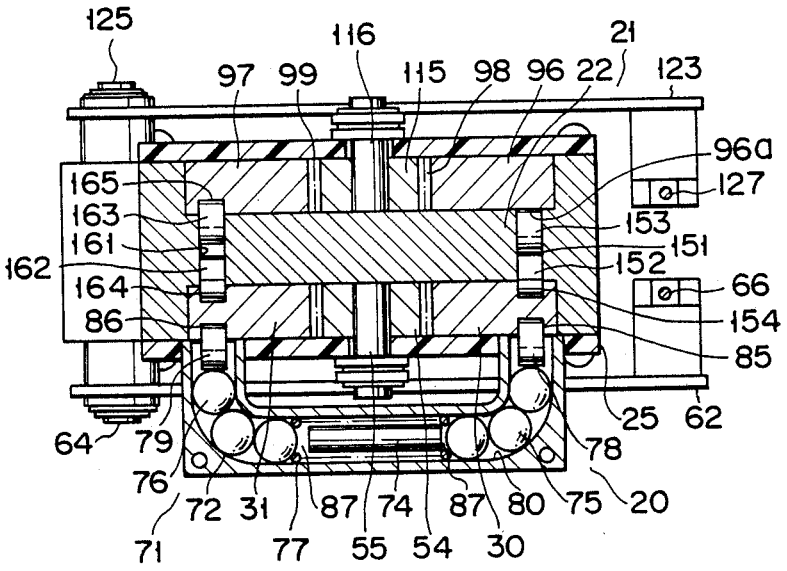

When the second control unit 52 is in the idling mode, as shown in FIG. 12, since the third rack 96 is moved by the cable 101, the throttle cable 127 is driven through the gear 115 and the links 122 and 123. In this case, as shown in FIG. 17, since the lock member 153 runs onto a surface 96*a* of the rack 96, the first rack 30 is locked by the lock member 152. For this reason, when the idling operation is performed using the second control unit 52, the lever 41 of the first control unit 42 can be prevented from being erroneously shifted to the forward or backward position.

As can be seen from the above description, the shifter 14 and the throttle lever 15 can be operated by either of the two control units 42 and 52. In addition, when one of the control units 42 and 52 is operated, the other is automatically locked.

Figure 18:
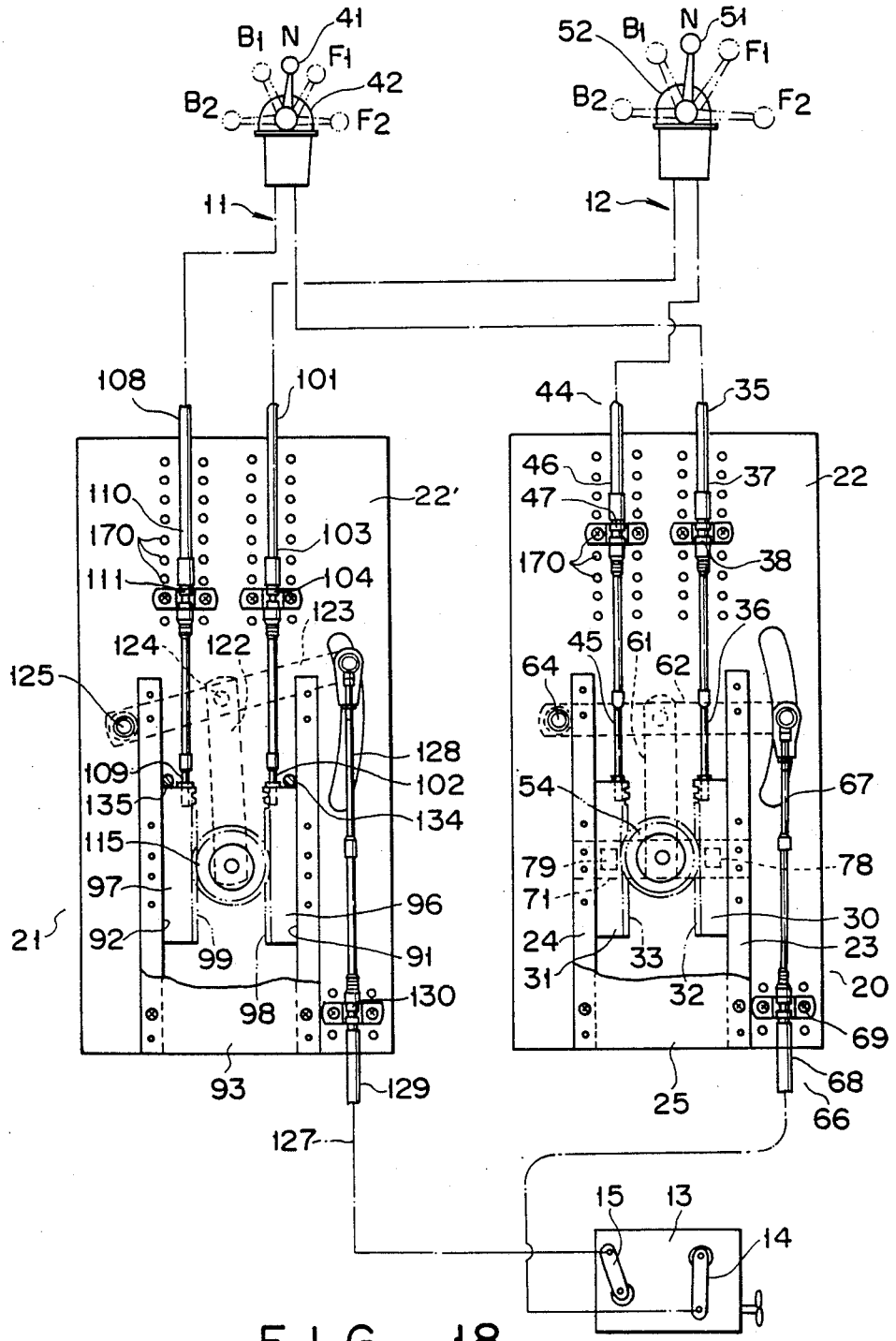
FIG. 18 is a plan view of a junction unit for controlling an engine according to a second embodiment of the present invention.

A second embodiment of the present invention shown in FIG. 18 comprises two bodies 22 and 22'. One body 22 comprises a shift junction unit 20. The other body 22' comprises a throttle junction unit 21. Ends of outer tubes 37, 46, 103, and 110 of cables are fixed to predetermined positions of the bodies 22 and 22' using a plurality of holes 170 and fixing members 38, 47, 104, and 111. The basic structure and operation of the second embodiment are the same as those in the first embodiment.

Figure 19:
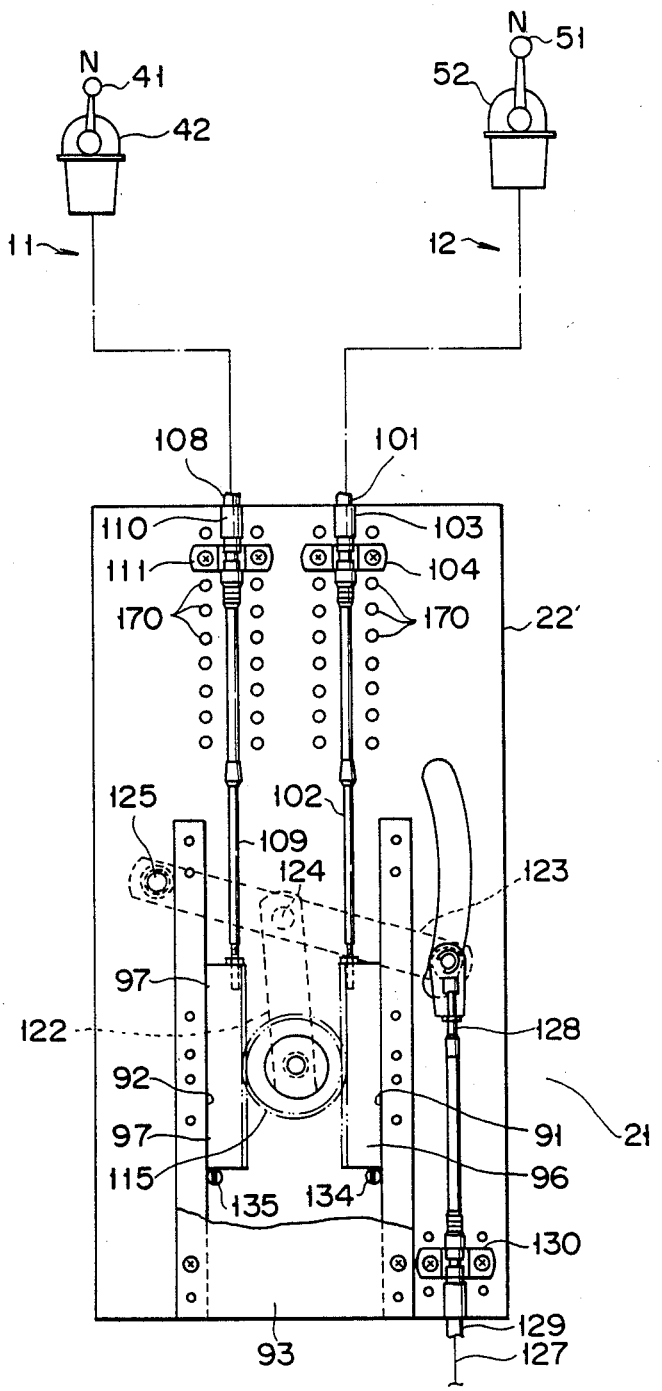
FIG. 19 is a plan view of a junction unit for controlling an engine according to a third embodiment of the present invention.

In a junction unit 21 according to a third embodiment of the present invention shown in FIG. 19, when a core 128 of a cable 127 is pulled, a throttle lever 15 is moved in an open direction.

In place of the single-lever control units 42 and 52, a two-lever control unit for performing shift control and throttle control using different levers may be used. The same lock means as the first lock means 71 can be arranged to extend over the racks 96 and 97. With this arrangement, when the idling operation is performed using one of the two control units 42 and 52, the throttle lever 15 can be prevented from being operated by the other control unit.

What is claimed is:

1. A junction unit arranged between first and second remote control units and a device to be controlled by said control units, comprising;

a body having one axis;

guide means arranged on said body and extending parallel to the axis;

first and second movable racks arranged to be movable from reference positions in the axial direction of said body along said guide means, said racks having opposing gears, and being arranged parallel to each other;

an intermediate gear located between said two racks to mesh with said gears of said racks to be movable in the axial direction of said body;

a first control cable connected to said first movable rack and said first remote control unit;

a second control cable connected to said second movable rack and said second remote control unit;

an interlocking member for, when said intermediate gear is moved in the axial direction of said body, transmitting the movement to said equipment to be controlled; and lock means for, when one of said first and second racks is moved in the axial direction of said body, locking movement of the other rack, said lock means including:

a guide hole having a U-shaped axis and two end openings facing surfaces of said first and second racks;

recesses formed in the surfaces of said first and second racks, said recesses opposing the two end openings of said U-shaped guide hole when said racks are located at the reference positions with respect to said body; and lock members housed in said U-shaped guide hole, said lock members being movable in the axial direction of said guide hole, being able to fit in said recesses when said first and second racks are located at the reference positions and, when one of said first and second racks is moved from its reference position, running onto the surface of the moved rack to be urged against the recess of the other rack.

2. A junction unit for controlling an engine of a ship, arranged between a first and second remote control unit and a shifter and a throttle lever controlled by said control units, comprising;

a body having one axis and a first surface and a second surface located at an opposite side to said first surface;

guide means arranged on said body and extending parallel to the axis;

first and second movable racks arranged to be movable from reference positions in the axial direction of said body along said guide means, said racks having opposing gears, and being arranged parallel to each other on said first surface of said body;

third and fourth movable racks arranged to be movable from reference positions in the axial direction of said body along said guide means, said racks having opposing gears, and being arranged parallel to each other on said second surface of said body;

a first intermediate gear located between said first and second racks to mesh with said gears of said first and second racks;

a second intermediate gear located between said third and fourth racks to mesh with said gears of said third and fourth racks;

a first control cable connected to said first movable rack and said first remote control unit;

a second control cable connected to said second movable rack and said second remote control unit;

a third control cable connected to said third movable rack and said second remote control unit;

a fourth control cable connected to said fourth movable rack and said first remote control unit;

a first interlocking member for, when said first intermediate gear is moved in the axial direction of said body, transmitting the movement to said shifter;

a second interlocking member for, when said second intermediate gear is moved in the axial direction of said body, transmitting the movement to said throttle lever;

first lock means for, when one of said first and second racks is moved from its reference position, locking movement of the other rack;

second lock means for, when one of said first and third racks is moved from its reference position, locking movement of the other rack, said second lock means including:

a hole extending through said body between said first and third movable racks;

recesses opposing two end openings of said hole when said first and third movable racks are located at the reference positions; and a second lock member which, when one of said first and third movable racks is moved from its reference position, runs onto the surface of the moved rack to be urged against the recess of the other rack; and third lock means for, when one of said second and fourth racks is moved from its reference position, for locking movement of the other rack, said third lock means including:

a hole extending through said body between said second and fourth movable racks;

recesses opposing two end openings of said hole when said second and fourth movable racks are located at the reference positions; and a third lock member which, when one of said second and fourth movable racks is moved from its reference position, runs onto the surface of the moved rack to be urged against the recess of the other rack.

* * * * *